United States Patent [19]

Weed

[11] Patent Number: 4,772,144

[45] Date of Patent: Sep. 20, 1988

[54] RIBBON CARTRIDGE HAVING REMOVABLE CAPSTAN

[75] Inventor: John M. Weed, Rochester, N.Y.

[73] Assignee: Burrows Corporation, Detroit, Mich.

[21] Appl. No.: 919,537

[22] Filed: Oct. 16, 1986

[51] Int. Cl.[4] ..... B41J 35/28

[52] U.S. Cl. ..... 400/208; 400/235.1

[58] Field of Search ..... 400/207, 208.1, 208

[56] References Cited

U.S. PATENT DOCUMENTS

| | | | |
|---|---|---|---|
| 3,411,731 | 11/1968 | Kelley | 242/199 |
| 3,731,781 | 5/1973 | Cardill et al. | 400/228 |
| 3,884,430 | 5/1975 | Martin | 242/199 |
| 3,995,731 | 12/1976 | Miller et al. | 400/208.1 |
| 4,034,935 | 7/1977 | Plaza et al. | 242/197 |
| 4,093,151 | 6/1978 | Karsh | 242/198 |
| 4,191,984 | 3/1980 | Tsukidate et al. | 242/199 |
| 4,222,557 | 9/1980 | Wu | 400/625 |
| 4,307,969 | 12/1981 | Daughters | 400/208 |
| 4,496,255 | 1/1985 | Meintrup et al. | 400/208 |
| 4,568,210 | 2/1986 | Privitera | 400/208 X |

FOREIGN PATENT DOCUMENTS

| | | | |
|---|---|---|---|
| 70687 | 5/1982 | Japan | 400/227.2 |
| 181677 | 10/1983 | Japan | 400/235.1 |

OTHER PUBLICATIONS

1983 Catalog, Mid-West Paper Products Co., p. 241, NEC Multi14 Strike Cartridge.

*Primary Examiner*—Edgar S. Burr
*Assistant Examiner*—James Lisehora
*Attorney, Agent, or Firm*—Fay, Sharpe, Beall, Fagan, Minnich & McKee

[57] ABSTRACT

A ribbon cartridge for use with a printer is disclosed having a removable capstan. The removable capstan may be interchanged with other capstans having different circumferences and configurations for engaging printer drive mechanisms of different printers. Both single pass and invertible cartridges may use the removable capstan of the present invention. In an invertible cartridge application, only one capstan is required to advance the ribbon in either direction.

6 Claims, 3 Drawing Sheets

RIBBON CARTRIDGE HAVING REMOVABLE CAPSTAN

BACKGROUND OF THE INVENTION

1. Field of the Invention

The invention relates to ribbon cartridges which utilize a capstan to advance the ribbon in the cartridge, and in particular those cartridges which are used in typewriters and printers.

2. Description of the Prior Art

The use of capstans to advance a ribbon in a cartridge has long been known in the art. Prior art devices may use either single or double capstans with idlers to advance the ribbon. These prior art capstans are either permanently housed within the cartridge or form an integral part of the machine which utilizes the cartridge itself.

Examples of prior art cartridges are numerous. U.S. Pat. No. 3,411,731 to Kelly discloses a tape cartridge having a single capstan permanently housed within the tape cartridge. U.S. Pat. No. 3,884,430 to Martin and U.S. Pat. No. 4,191,984 to Tsukidate et al. disclose tape cassettes having no capstans or idlers housed in the tape cartridge, instead advancing the tapes with capstans and idlers integral to the machines utilizing the cassettes. U.S. Pat. No. 4,093,151 to Karsh discloses yet another variation wherein the capstans used to advance the tape are an integral part of the machine utilizing the cassette, but idlers permanently mounted within the cassette are used to urge the tape against the capstans.

Ribbon cartridges utilized in printer applications have capstans permanently housed in the cartridge, since printers typically do not have capstans and idlers as integral parts of the printers themselves. The capstans in such ribbon cartridges have means for engaging a drive mechanism in the printer which is used to rotate the capstans. Examples of such ribbon cartridges include U.S. Pat. No. 4,034,935 to Plaza et al. and U.S. Pat. No. 4,496,255 to Meintrup et al.

Plaza et al. discloses a single pass ribbon cartridge having a capstan permanently housed in the cartridge casing. A disadvantage of such cartridges is that the cartridges are limited to use with printers that have the specific drive mechanism designed to engage the capstan housed in the cartridge casing. In addition, the speed at which the tape advances in the cartridge is determined by the circumference of the particular capstan housed in the casing. As a result, an entirely new cartridge must be manufactured for printers differing only in the configuration of the engaging portion of the printer drive mechanism or the rotational speed of the printer drive mechanism.

Meintrup et al. discloses an invertible ribbon cartridge utilizing two capstans permanently housed within the ribbon cartridge casing. Although Meintrup et al. requires two capstans in the ribbon cartridge, only one capstan at a given time is used to advance the ribbon. Meintrup et al. thus has the disadvantage of requiring the assembly of more parts than are necessary to advance the ribbon at a given time, in addition to the disadvantages previously mentioned for Plaza et al.

A prior art multistrike ribbon cartridge marketed by NEC Corporation utilizes the dual capstan arrangement disclosed in Meintrup et al. In addition, the NEC cartridge has a pair of capstan idlers mounted on a slidable bar and capstan pulleys attached to a portion of the capstans extending beyond the faces of the cartridge.

While this combination permits the capstans to alternately engage the ribbon, the NEC device still suffers from the disadvantages of Meintrup et al., since the capstans themselves are permanently housed within the cartridge casing.

In view of the above disadvantages of the prior art, an object of the present invention is to allow a universal ribbon cartridge to be used with printers differing only in configuration and rotational speed of their cartridge drive mechanisms by simply changing capstans in the universal cartridge.

A further object of the invention is to reduce assembly costs of dual capstan or invertible ribbon cartridges by using a single capstan in the cartridge, and thereby eliminating one of the capstans with its associated parts.

SUMMARY OF THE INVENTION

In accordance with the present invention a ribbon cartridge is provided which utilizes a removable capstan. The removable capstan in the present invention may be interchanged with other capstans having different circumferences to accommodate use of the same ribbon cartridge in printers having drive mechanisms of different rotational speeds. Interchangeability of capstans having different printer drive engaging means further allows use of the same ribbon cartridge with printers having cartridge drive mechanisms of different configurations.

In one configuration of the invention, a single capstan may be alternately placed in the cartridge casing through openings associated with either of two ribbon take-up spools to advance the ribbon toward one or the other of said spools respectively. A slidable idler bar is provided to urge the ribbon against the capstan upon placement of the capstan in the casing. In addition, a capstan pulley is attached to a portion of the capstan extending beyond the casing to rotatably secure the capstan in the casing and to provide a means of transferring rotational motion from the capstan to the spool toward which ribbon is being advanced.

DESCRIPTION OF THE PREFERRED EMBODIMENT

Figure 1:
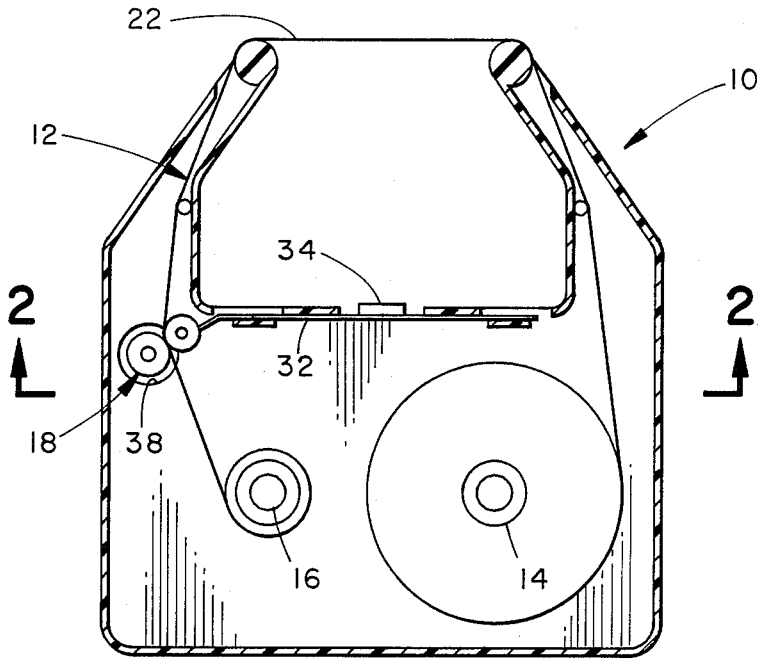
FIG. 1 is a view of a single pass cartridge of the present invention with a face of the cartridge housing removed.
Figure 2:
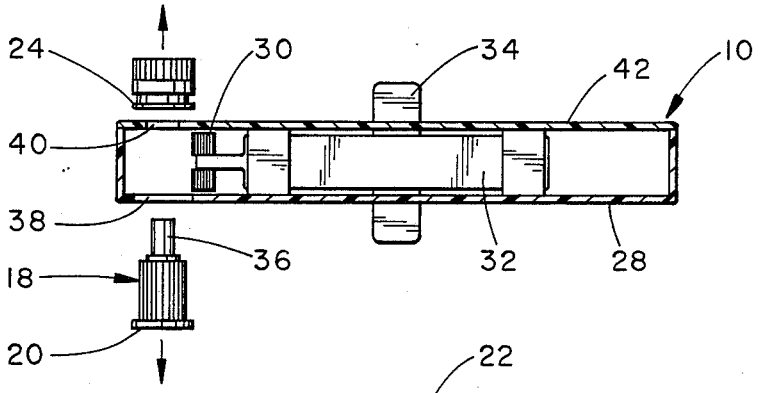
FIG. 2 is a cutaway view of a single pass cartridge of the present invention taken along line 2—2 with the removable capstan and pulley disassembled from the cartridge.
Figure 3:
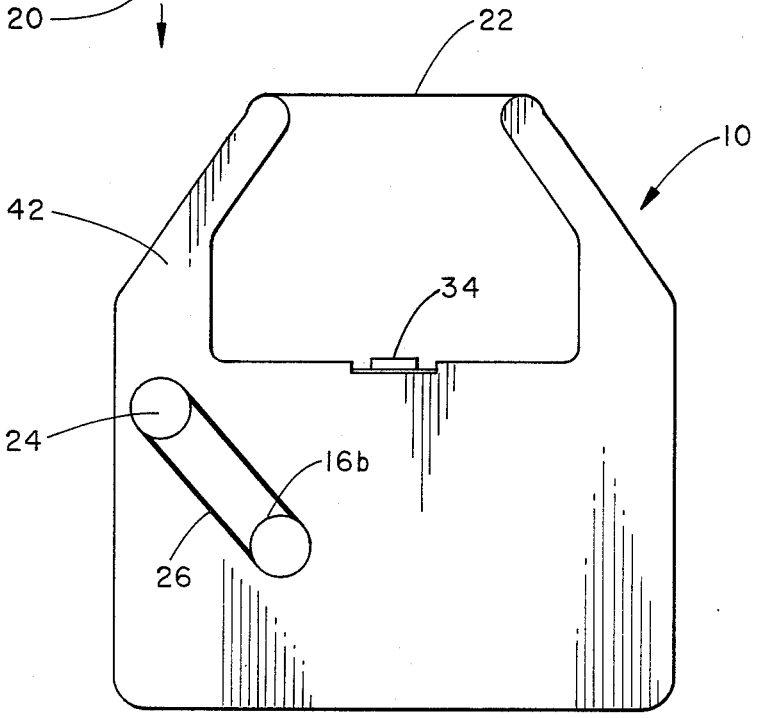
FIG. 3 is a top view of a single pass cartridge of the present invention with the capstan pulley and spool drive belt in place.

Referring to FIGS. 1, 2, 3 and 7, a single pass cartridge 10 of the present invention is shown. In use the cartridge 10 is snapped in place in a printer or typewriter which is not shown. Also not shown is the drive mechanism of the printer which engages a removable capstan 18, typically through insertion of a drive shaft which is associated with the printer drive mechanism in the bottom area 20 of the capstan 18. Associated with the removable capstan 18 is a detachable capstan pulley portion 24 which is axially aligned with the capstan 18. The capstan pulley 24 is connected to the capstan 18 by friction or other suitable means. A reach 22 of a ribbon 12 is impacted by the print head of the printer to transfer ink pigment carried on the ribbon 12 to a work surface on which printing is desired.

Figure 8:
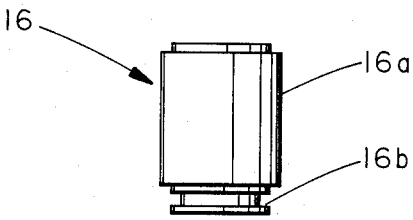
FIG. 8 is a view of a ribbon spool of the present invention.

While printing is taking place, the drive mechanism of the printer rotates the removable capstan 18 to advance the ribbon 12 from a feed spool 14 toward a take-up spool 16. As shown in FIG. 8 the spool 16 comprises hub portion **16*a* and a pulley portion 16*b* which is axially aligned with the hub portion 16*a*. As the removable capstan 18 is rotated by the printer drive mechanism, the capstan 18 rotates take-up spool 16 via an elastic take-up drive belt 26 which is coupled to the capstan pulley 24 and the pulley porton 16*b* of the take-up spool 16. Rotation of the take-up spool 16 allows the take-up spool 16 to receive the ribbon 12 as it is advanced by the capstan 18**.

A capstan idler or pinch roller 30 is used to urge the ribbon 12 against the capstan 18 to maintain engagement of the capstan 18 with the ribbon 12 during advancement of the ribbon 12. The capstan idler 30 is rotatably attached to one end of a slidable idler bar 32.

To remove the capstan 18 to interchange it with other capstans of different configurations, such as those shown in FIG. 7, the operator first disengages the capstan 18 from the ribbon 12 by sliding the idler bar lever 34 away from the capstan 18. The elastic take-up spool belt 26 is then removed by simply sliding the belt 26 off the capstan pulley 24 and take-up spool pulley portion **16*b*. Capstan pulley 24 is then pulled off a portion 36 of capstan 18 which extends through an opening 40 in a first braod face 42 of the cartridge 10. At this point, the capstan 18 may be removed from the cartridge 10 by simply pushing on the capstan extension 36 to drop the capstan out of the other broad face 28 of cartridge 10 through a capstan opening 38**.

To place a different capstan 18 in the cartridge 10, the steps taken for removal are simply reversed. A new capstan is first pushed into the cartridge 10 through the capstan opening 38 such that capstan extension 36 passes through the opening 40 and extends beyond face 42 of cartridge 10. Capstan pulley 24 is then reattached onto extension 36 to secure the capstan 18 in place in the cartridge. The take-up spool drive belt 26 is then slipped over capstan pulley 24 and pulley portion **16*a* of take-up spool 16. Finally, the idler bar lever 34 is moved toward capstan 18 such that the capstan idler 30 urges the ribbon 12 into engagement with the capstan 18**.

Figure 4:
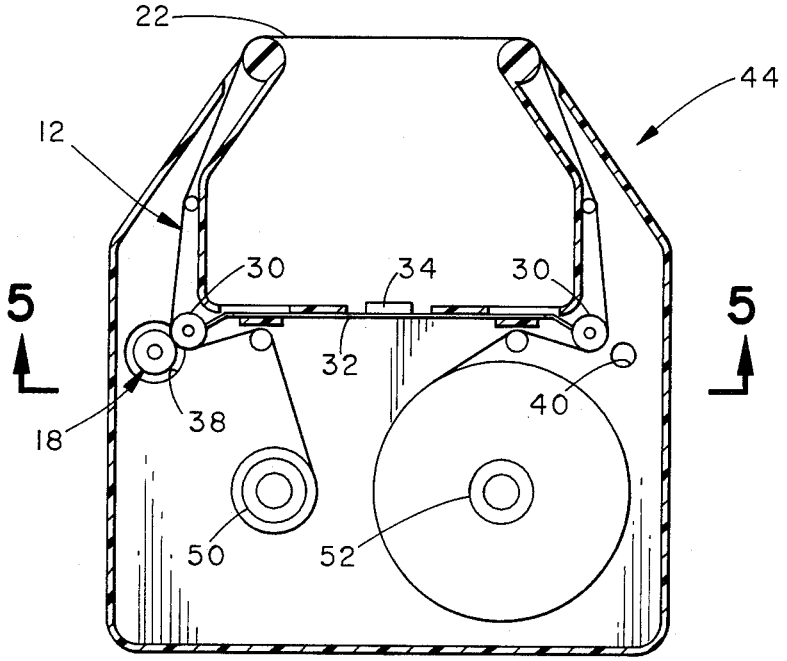
FIG. 4 is a view of an invertible cartridge of the present invention with a face of the casing removed.
Figure 5:
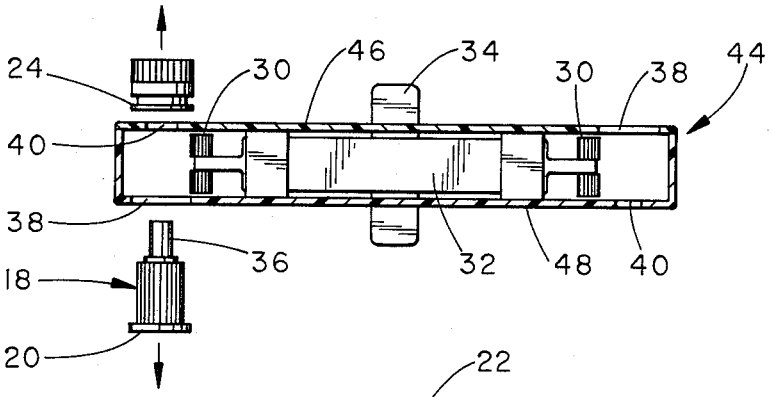
FIG. 5 is a cutaway view of an invertible cartridge of the present invention taken along line 5—5 with the removable capstan and pulley disassembled from the cartridge.
Figure 6:
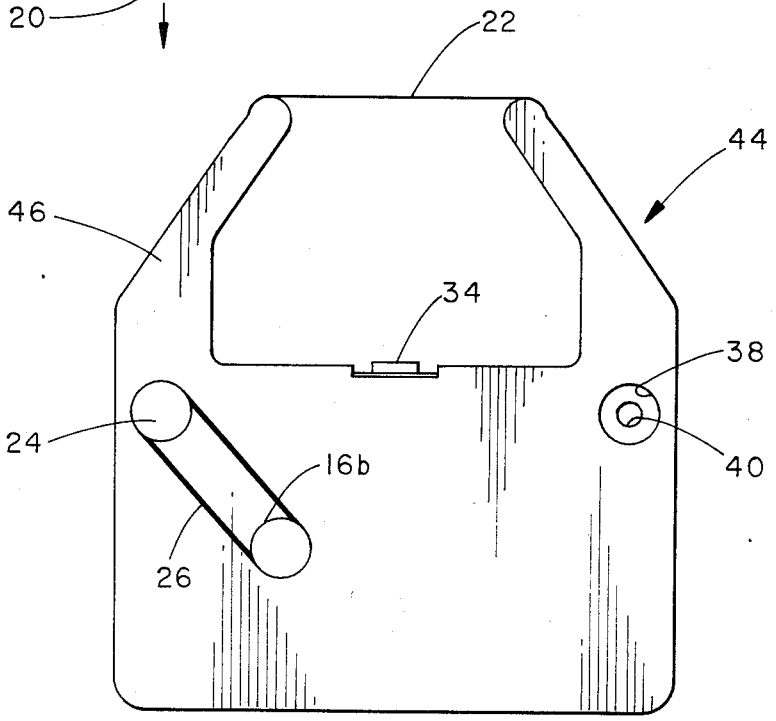
FIG. 6 is top view of an invertible cartridge of the present invention with the capstan pulley and spool drive belt in place.
Figure 7A:
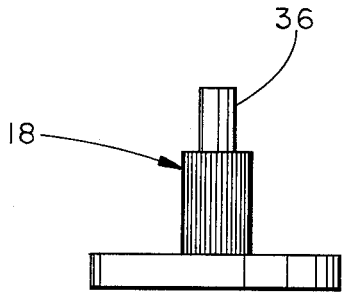
FIGS. 7A and 7B are, respectively, a side elevational view and a bottom plan view of one type of removable capstan.
Figure 7C:
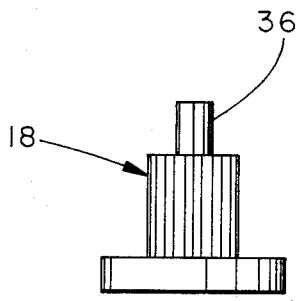
FIGS. 7C and 7D are, respectively, a side elevational view and a bottom plan view of a second type of removable capstan.
Figure 7B:
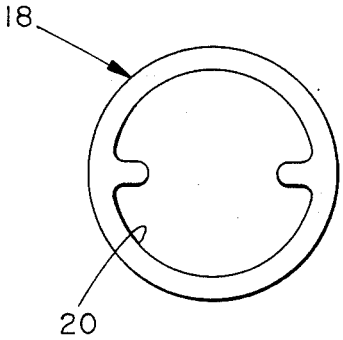
Figure 7D:
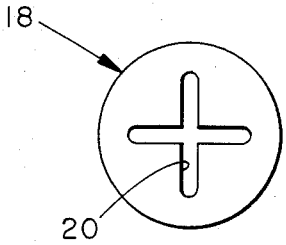

Referring now to FIGS. 4, 5 and 6, an invertible cartridge 44 is shown. In the invertible cartridge 44 the steps of removing and replacing the capstan 18 are basically the same as those in the single pass cartridge 10.

The invertible cartridge 44 differs from the single pass cartridge 10, however, in that two capstan openings 38 are provided in the opposed faces 46 and 48 of the cartridge 44 rather than a single capstan opening 38 as in the single pass cartridge 10. In addition a second capstan idler 30 is attached to the other end of the idler bar 32. This allows the capstan 18 to be placed in the invertible cartridge 44 in association with either of two take-up spools 50 and 52 depending on which capstan opening 38 is selected for insertion of the capstan 18. As such, the ribbon 12 can be alternately advanced toward spool 50 or 52 by simply switching the position of capstan 18 in the cartridge 44 and appropriately engaging the capstan idler 30 into contact with the ribbon 12 and the capstan 18.

In use, the ribbon 12 would be advanced in the cartridge toward spool 50 until the end of the ribbon was reached on spool 52, whereupon the printer would stop. A variety of mechanism are well known in the art to perform this end of ribbon feature and are not discussed herein. The operator would then remove the invertible cartridge 10 from the printer and transfer the capstan 18 to the capstan opening 38 in association with the spool 52 in accordance with the steps discussed above. The operator would then place the cartridge 44 in the printer in an inverted position, engaging the capstan 18 with the drive mechanism of the printer such that the ribbon 12 is now advanced toward spool 52 from spool 50. The operator would continue to invert the cartridge back and forth each time the end of the ribbon is reached on the spools, until such time as the ribbon runs out of ink and no longer gives acceptabe print quality, whereupon the cartridge 44 would be replaced.

From the foregoing description, it will be apparent that there has been provided an improved ribbon cartridge. While the cartridge has been described in functional terms, it will be appreciated that various modifications may be made therein. For example the idler bar may be replaced with spring load tensioning means, and while the ribbon spools have been shown to be coplanar, this need not be the case. In additon a double width ribbon can be used so as to double the amount of printable characters obtained from each cartridge. Accordingly, the foregoing description should be taken as illustrative and not in any limiting sense.

What is claimed is:

1. A ribbon cartridge for use in a printer, said cartridge comprising:

a casing having two opposed, broad faces;

a first and second spool rotatably mounted in the casing;

an inked ribbon wound on said spools and including a reach extending out of said casing between said spools for engagement by a print head in the printer;

a removable capstan for advancing the ribbon and having means for engaging a drive mechanism of the printer;

a removable capstan for advancing the ribbon and having means for engaging a drive mechanism of the printer;

means for allowing the capstan to be selectively removed from and replaced into the casing in association with either the first or second spool to advance the ribbon toward either the first or second spool respectively;

means for rotating the spool toward which ribbon is being advanced to take up the advancing ribbon on said spool;

said means for allowing the capstan to be selectively removed from and replaced into said casing comprising an opening in each of said broad faces associated with the first and second spools respectively for receiving the capstan in the casing, and means for urging the ribbon against the capstan upon placement of the capstan in the casing; and, wherein said ribbon urging means includes an idler bar having two ends and slidably mounted within the casing, and a pair of capstan idlers mounted on opposite ends of the idler bar such that said capstan idlers urge the ribbon against the capstan by sliding the idler bar toward the capstan.

2. A ribbon cartridge as claimed in claim 1 wherein said means for rotating the spools comprises:

a capstan pulley attached to the capstan;

spool pulleys attached to each of the spools; and a removable, elastic belt for connecting the capstan to the spool which is desired to be rotated to transmit rotational motion from the capstan to said spool.

3. A ribbon cartridge as claimed in claim 2 wherein:

said capstan includes a portion extending beyond one of said broad faces; and the capstan pulley comprises a removable knob which may be pushed on said portion of the capstan extending beyond the broad face to rotatably secure the capstan within the casing.

4. An improved ribbon cartridge for use with a printer, said ribbon cartridge having a casing and being of the type in which a capstan in the casing directly engages and advances ribbon in the casing, said capstan having means for engaging a rotating drive mechanism in the printer wherein the improvement comprises means for allowing said entire capstan to be selectively removed from the casing or replaced into operating position within said casing withoutdisassembling said casing and including an opening in said casing through which said capstan can be removed and replaced and said cartridge further comprising a manually detachable pulley means located exterior to said casing and connectable to said capstan and releasable exteriorly of said casing for releasably retaining said capstan in said casing.

5. The improved ribbon cartridge as claimed in claim 4 wherein said casing includes opposed broad exterior braces and said opening extends through one of said broad exterior faces.

6. The improved ribbon cartridge as claimed in claim 5 wherein said opening in said casing is axially aligned with the operating position of said capstan.

* * * * *

UNITED STATES PATENT AND TRADEMARK OFFICE

CERTIFICATE OF CORRECTION

PATENT NO. : 4,772,144

DATED : September 20, 1988

INVENTOR(S) : John M. Weed

It is certified that error appears in the above-identified patent and that said Letters Patent is hereby corrected as shown below:

On the title page assignee should read

--(73) Assignee: Burroughs Corporation --.

Signed and Sealed this

Fourth Day of July, 1989

*Attest:*

*Attesting Officer*

DONALD J. QUIGG

*Commissioner of Patents and Trademarks*